US005424727A

United States Patent [19]

Shieh

[11] Patent Number: 5,424,727

[45] Date of Patent: Jun. 13, 1995

[54] METHOD AND SYSTEM FOR TWO-WAY PACKET RADIO-BASED ELECTRONIC TOLL COLLECTION

[75] Inventor: Jin S. Shieh, Hsin-Chu, Taiwan, Prov. of China

[73] Assignee: Best Network Systems, Inc., Taipei, Taiwan, Prov. of China

[21] Appl. No.: 215,571

[22] Filed: Mar. 22, 1994

[51] Int. Cl.[6] ..... G08G 1/00

[52] U.S. Cl. ..... 340/928; 340/933; 340/937; 340/825.54; 342/42; 342/456; 235/384; 364/436

[58] Field of Search ..... 340/928, 933, 937, 825.54, 340/941–943, 825.03; 342/42, 44, 454, 456; 235/384, 380, 472; 364/401, 403, 406, 436; 370/85.2

[56] References Cited

U.S. PATENT DOCUMENTS

| | | | |
|---|---|---|---|
| 5,101,200 | 3/1992 | Swett | 340/928 |
| 5,289,183 | 2/1994 | Hassett et al. | 340/928 |
| 5,307,349 | 4/1994 | Shloss et al. | 340/825.54 |
| 5,351,052 | 9/1994 | D'Hont et al. | 342/42 |

*Primary Examiner*—Donnie L. Crosland
*Attorney, Agent, or Firm*—Cushman Darby & Cushman

[57] ABSTRACT

A two-way packet radio-based electronic toll collection system is to be installed on a highway and includes a main communication tower for transmitting continuously downlink communication packets that contain information regarding available uplink communication channels, and an in-vehicle unit installed in each vehicle passing along the highway to receive the downlink communication packets. The in-vehicle unit is capable of selecting one of the available uplink communication channels. The in-vehicle unit and the main communication tower exchange toll collecting and payment information wirelessly via the available uplink communication channel selected by the in-vehicle unit and a downlink communication channel corresponding thereto. When collision occurs along the packets transmitted by a number of in-vehicle units, a retransmission scheme is applied for each in-vehicle unit to guarantee successful communication between the tower and the in-vehicle unit.

20 Claims, 3 Drawing Sheets

METHOD AND SYSTEM FOR TWO-WAY PACKET RADIO-BASED ELECTRONIC TOLL COLLECTION

BACKGROUND OF THE INVENTION

1. Field of the Invention

The invention relates to an electronic toll collection method and system, more particularly to a two-way packet radio-based electronic toll collection method and system which utilizes multipoint-to-point communication to exchange toll collecting and payment information.

2. Description of the Related Art

Presently, most of the toll collecting functions in a conventional manual toll collection system are implemented with the physical presence of toll collectors. Such a system can only process about 900 vehicles per hour. As the vehicle approaches the toll booth, it reduces its speed, pays the toll, then speeds up and leaves. This system tends to cause congestion around the toll booth, stalling of traffic flow, exacerbation of air pollution and results in waste of time and energy. In order to tackle these problems, many companies and research agencies in industrialized countries have devoted their research and development efforts on the development of electronic toll collection systems.

The underlying principles behind the toll collecting functions of the different electronic toll collection systems developed all over the world are similar. Toils can be collected in the following ways:

(1) deducting directly the tolls from an electronic card installed in the vehicle by radio wave communication;

(2) deducting the tolls from the balance of an electronic card, which balance being recorded by a control computer; or (3) using a control computer to collect the tolls via data of an electronic card of an In-Vehicle Unit and transmitted wirelessly by the latter, and deducting the tolls from the electronic card after the data transmitted by the In-Vehicle Unit have been verified. To avoid any fraudulence, vehicle-type detectors and photographic equipments may be added to the system. For further protection against toll evasion, the system may incorporate an alarm device that can alert the motorist of low card balance and that is linked to an automatic control system and to a computer telecommunication equipment.

Different traffic congestion problems require different solutions in electronic toll collection systems. The lane-based toll collection system functions well in places that have a relatively low traffic volume but may not apply in areas where heavy traffic occurs regularly. In a lane-based toll collection system, a sensor is installed in every lane to initiate point-to-point communication with the vehicles that pass through the corresponding lane in order to achieve the toll collecting function.

The following are brief descriptions of the different electronic toll collection systems developed in different countries:

1. The AMTECH system developed in the. United States This system operates in the following manner:

a. As a vehicle passes by a sensor that is disposed underneath the surface of the highway, signals are transmitted to equipment installed on the roadside.

b. The antenna on the roadside then transmits radio waves to the vehicle via point-to-point communication. Data stored in a tag of the vehicle are transmitted to the antenna in order to enable the equipment on the roadside to verify the validity and balance of the tag.

c. A discrepancy in the data will trigger alarms or will cause the activation of a camera so as to take a picture of the vehicle.

d. If the balance is too low, the system will alert the motorist with the use of a red lamp.

e. If everything is in good order, the system will signal the motorist to pass through the toll booth. The tolls can be deducted from the card at this stage.

2. The AT&T system

This system operates in the following manner:

a. A reader installed on the roadside transmits control signals every 10 msec.

b. As soon as the machine detects the arrival of a vehicle, it will transmit pulse signals, inclusive of the code of the lane, to a transponder on the vehicle via point-to-point communication.

c. Upon receiving the signals from the reader, the transponder on the vehicle will transmit signals, inclusive of the vehicle model and identification, to the reader via point-to-point communication.

d. The reader will process the signals received from the vehicle and transmits the results to the transponder in order to deduct the tolls therefrom.

These two systems participated but failed in a road test held in the United States.

3. The AT/COMM system

This system operates in the following manner:

a. A first communication tower located ½ mile away from the toll booth transmits continuously one-way signals to inform a transponder of the vehicle to prepare payment of a certain amount of tolls.

b. The transponder checks its own memory to see if there is a sufficient balance. In case the balance is insufficient, the transponder will alert the motorist with the use of a beeper and warning lamps to instruct the motorist to switch to other lanes where tolls can be collected manually.

c. If there is a sufficient balance, the motorist can continue to pass through the lane. The transponder then transmits signals to a second communication tower via point-to-point communication with regards to the vehicle ID and the balance of the transponder. As the data pass from a reader to a lane controller, tolls will be deducted from the transponder.

d. Finally, after the tolls have been paid, the code of the lane and the card balance will be stored by the transponder of the vehicle in its memory.

4. The SAIC system

This system combines the traditional toll collection equipment, the vehicle recognition equipment and the communication equipment. Since tolls are to be paid in coins, and since communication is lane-based, speed limits have to be imposed on vehicles passing through the toll booth. This constraint tends to slow down the traffic and can cause traffic jams. Besides, this system only provides one-way communication capability which cannot meet the requirements of an Intelligent Vehicle Highway System (IVHS).

5. The 3M system developed in the United States

This system operates in the following manner:

a. As a vehicle passes by a sensor that is disposed underneath the surface of the highway, the sensor will transmit signals to notify a control computer of the lane.

b. The sensor also activates a photographic equipment to take a picture of the vehicle. The picture is converted into an electrical signal and is stored in an integrated circuit in order to enable the system to identify the vehicle model.

c. An antenna located on the roadside will transmit signals to a surface acoustic wave (SAW) card of the vehicle. The card is not equipped with a signal transmission mechanism but can reflect surface acoustic wave to a card reading machine.

d. The card reading machine decodes the number of the card and transmits this number to the control computer.

e. The control computer then obtains the user's status from its database and performs the following tasks:

e1. If the vehicle does not carry an SAW card or if the card is invalid, the system will activate a red lamp or will set off an alarm. In the meantime, the picture of the vehicle will either be printed out for summons or transmitted to the next toll booth for interception.

e2. If the card is valid but has an insufficient balance, the system will activate a yellow lamp to alert the motorist while recording relevant data in the meantime.

e3. If the card is valid and has a sufficient balance, the system will activate a green lamp and record relevant data.

Note that this system conducts one-way communication via reflection. Thus, it cannot accommodate the requirements of IVHS.

6. The PAMALA system developed in Europe

This system operates in the following manner:

a. A vehicle is equipped with an In-Vehicle Unit and a detachable smart card with a microprocessor controller and a communication interface. Some cards can even come with detecting components.

b. The roadside network is equipped with a central control unit and signal poles. As the vehicle passes the warning zone, the signal poles on the side of each lane will transmit signals to the In-Vehicle Unit via point-to-point communication.

c. The system will activate a congestion measurement device to begin two-way communication to exchange relevant information with regards to the toll amount due, the parking space available, the possible length of delay, etc.

d. At the same time, an On-Board Unit will be triggered to collect tolls by deducting the amount from the smart card.

e. The data received by the vehicle can be stored in the memory of the communication unit of the vehicle.

f. The In-Vehicle Unit will generate audio or visual warning signals to inform the motorist about every procedure. After the tolls have been paid, the new balance will be displayed.

g. Tolls can be fixed or adjusted to reflect peak or non-peak condition rates.

7. The PREMID system developed by Philips of Holland and CSEE of France

This system operates in the following manner:

a. A roadside antenna transmits a low power radio wave to allow only one vehicle to receive the same.

b. As a vehicle passes by, data stored in an electronic card of the vehicle will be transmitted to the roadside antenna via reflection of the radio wave.

c. The system compares the received data with those stored in its database.

d. If the electronic card turns out to be invalid or has an insufficient balance, the system will set off an alarm and activate photographic equipment to take a picture of the delinquent vehicle for use as evidence.

e. If the electronic card is valid, the system will activate a green lamp and deduct the tolls from the card.

8. The Automatic Toll Collection System developed by Panasonic of Japan

This system operates in the following manner:

a. A sensor of the system detects the entry of a vehicle into a divided lane of the toll area.

b. The system will take a picture of the vehicle and store the picture for model verification.

c. In the divided lane, a detached IC card in the vehicle conducts point-to-point communication four times to transmit data in the card to a roadside antenna.

d. A card processing equipment on the roadside will process the received signals to ensure that the card is valid and that there is a sufficient balance before the tolls can be deducted from the card. The data is updated and transmitted to the IC card and to other relevant entities.

e. A roadside display device will show the amount of tolls paid and the new balance.

f. If the major antenna is inoperable, a back-up antenna is employed to handle emergency communication.

9. The ERP system developed in Holland

This system is used in Singapore to control traffic entering the downtown area. The system operates in the following manner:

a. Vehicles are equipped with a smart card and a card reading system.

b. The smart card is plugged in as a vehicle enters a restricted area.

c. As the vehicle passes a control point, an antenna will transmit signals via point-to-point communication to activate the In-Vehicle Unit so as to enable the latter to process incoming data and transmit reply signals to the roadside unit.

d. A roadside processor then verifies the validity and balance of the card.

e. If everything is in good order, tolls are deducted from the card. Otherwise, the motorist will receive warning signals from light emitting diodes (LED) or beepers. Data is then sent to a central computer for further action.

f. If the system cannot detect the presence of a valid card reading system, a camera is activated to take a picture of the delinquent vehicle.

Note that the different electronic toll collection systems described beforehand are lane-based. Furthermore, the exchange of data and card verification procedures are conducted via point-to-point communication. This will impose a certain speed limit on the vehicles passing through the toll booth and require a certain distance to be kept between two vehicles on the same lane. In the lane-based system, the toll collection system is installed on every lane. Since data exchange and toll collecting functions are to be carried out within a short distance, speed limits will be imposed on vehicles passing through the toll booth. These systems may work well in countries where the traffic density is low, but will not function well in over-congested areas where two vehicles may travel the same lane and compete for the same communication unit.

SUMMARY OF THE INVENTION

An objective of the present invention is to provide a two-way packet radio-based electronic toll collection method and system which employs channel-selection multiple access (CsMA) to permit multiple users to compete for available channels to exchange toll collecting and payment information irrespective of the division of lanes.

Another objective of the present invention is to provide a two-way CsMA toll collection method and system that is easy to implement, that can be easily expanded, and that can accommodate the requirements of an Intelligent Vehicle Highway System (IVHS).

Still another objective of the present invention is to provide a two-way CsMA toll collection method and system that may overcome the shortfalls inherent in conventional lane-based toll collection systems, .i.e. interference between adjacent lanes and the distance constraint imposed between two cars on the same lane.

A further objective of the present invention is to provide a two-way CsMA toll collection method and system in which payment or collection of tolls is done with the use of electronic cards that can be used to store personal data and to settle payment through the card holder's accounts in financial institutions, thereby obviating the need for handling physically tickets or cash.

In one aspect of the present invention, a two-way packet radio-based electronic toll collection method is to be implemented on a highway and comprises the steps of:

providing a communication tower which transmits continuously downlink communication packets that contain information regarding available uplink communication channels;

installing an in-vehicle unit in each vehicle passing along the highway to receive the downlink communication packets, the in-vehicle unit selecting one of the available uplink communication channels; and exchanging toll collecting and payment information wirelessly between the in-vehicle unit and the communication tower via the available uplink communication channel selected by the in-vehicle unit and a downlink communication channel corresponding thereto.

In another aspect of the present invention, a two-way packet radio-based electronic toll collection system is to be installed on a highway and comprises a main communication tower for transmitting continuously downlink communication packets that contain information regarding available uplink communication channels, and an in-vehicle unit installed in each vehicle passing along the highway to receive the downlink communication packets. The in-vehicle unit is capable of selecting one of the available Uplink communication channels via CsMA. The in-vehicle unit and the main communication tower exchange toll collecting and payment information wirelessly via the available uplink communication channel selected by the in-vehicle unit and a downlink communication channel corresponding thereto.

BRIEF DESCRIPTION OF THE DRAWINGS

Other features and advantages of the present invention will become apparent in the following detailed description of the preferred embodiment, with reference to the accompanying drawings, of which.

DETAILED DESCRIPTION OF THE PREFERRED EMBODIMENT

Figure 1:
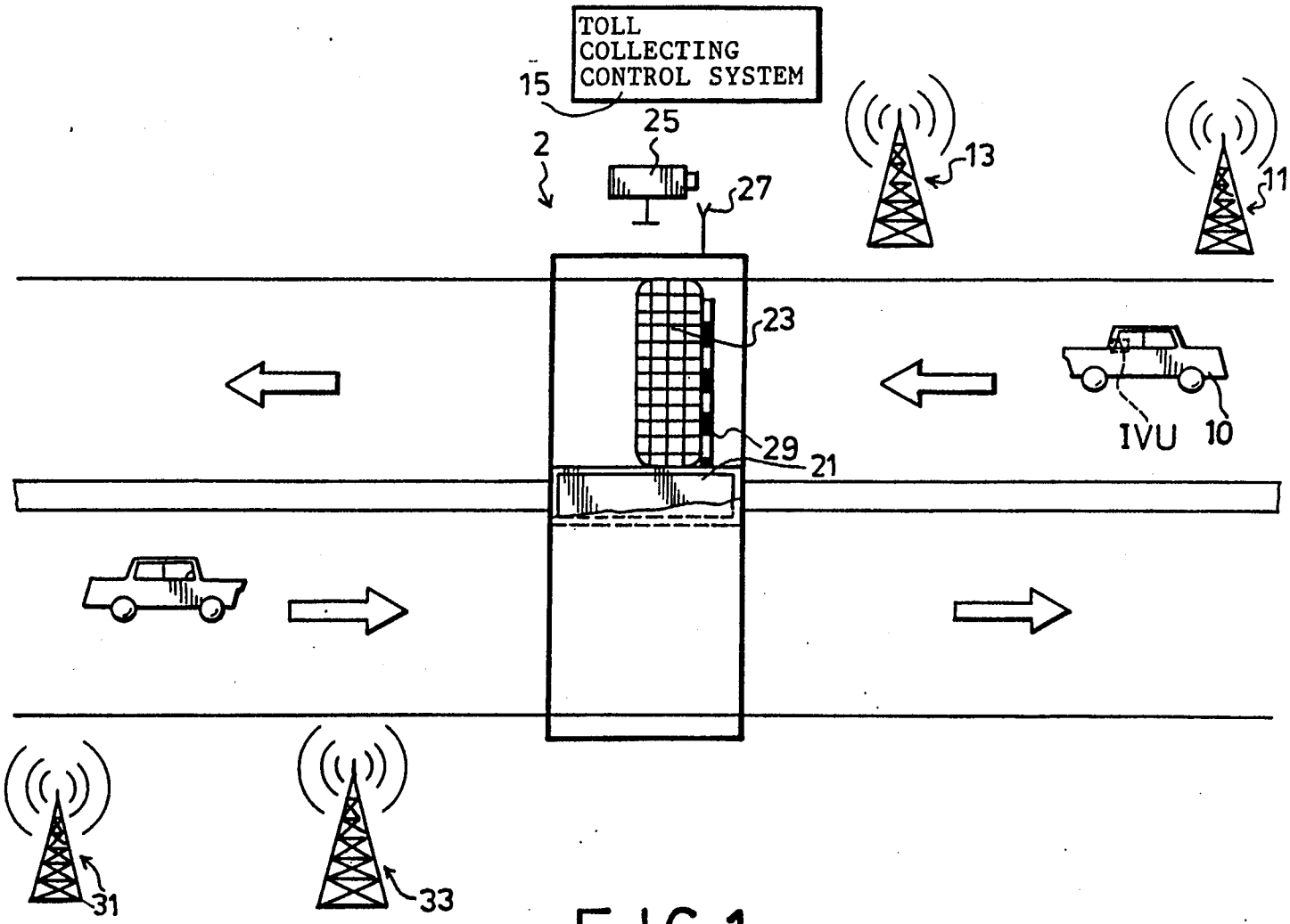
FIG. 1 illustrates the preferred embodiment of a two-way packet radio-based electronic toll collection system according to the present invention.
Figure 2:
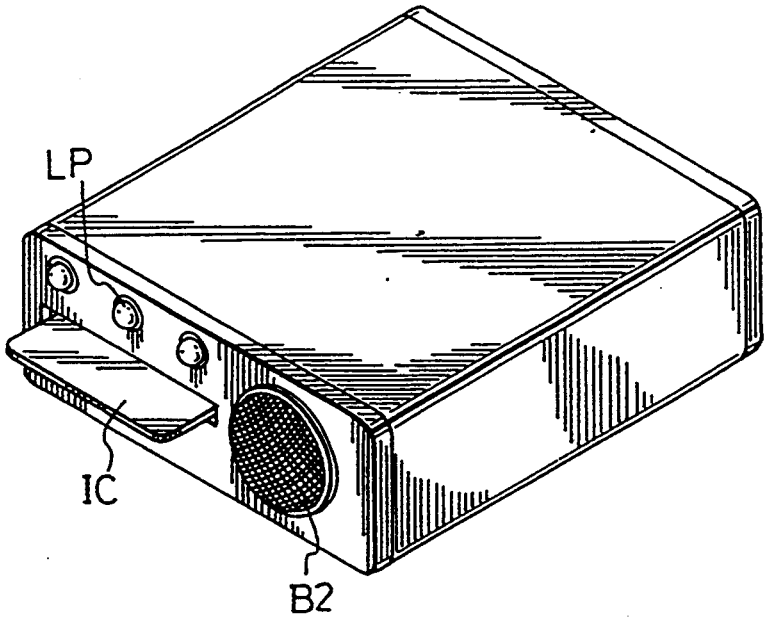
FIG. 2 is an illustration of an In-Vehicle Unit of the preferred embodiment.

Referring to FIGS. 1 and 2, the operation of the preferred embodiment of a two-way packet radio-based electronic toll collection system according to the present invention is as follows:

1. An In-Vehicle Unit (IVU) is provided with an IC card (IC) and is installed in each vehicle 10. The In-Vehicle Unit (IVU) is normally in an energy-saving or sleep mode and listens for signals every Y seconds. As the vehicle 10 approaches a toll booth 2, an auxiliary roadside communication tower 11, disposed about 3 kilometers from the toll booth 2, transmits a reset signal to the In-Vehicle Unit (IVU) to request resetting of a toll station code previously recorded by the latter.

2. A main roadside communication tower 13, located about 1.5 kilometers from the toll booth 2, transmits downlink communication packets continuously. These communication packets contain toll payment information, the toll station code, and the available uplink communication channels. As the In-Vehicle Unit (IVU) receives one of the packets, it picks an available uplink communication channel and transmits to the main roadside communication tower 13 toll payment information, such as the vehicle ID and type code and the card number and balance of the IC card (IC), at the beginning of a slotted time.

3. The main roadside communication tower 13 then passes the toll payment information received from the In-Vehicle Unit (IVU) to a toll collecting control system 15 for verification. If all data are valid, the main communication tower 13 will respond to the In-Vehicle Unit (IVU) to confirm the vehicle ID and the payment due.

4. In the event that communication between the tower 13 and the In-Vehicle Unit (IVU) is unsuccessful, steps 2 and 3 are repeated after a time depending upon the roundtrip time required for transmitting a communication packet.

5. If communication between the tower 13 and the In-Vehicle Unit (IVU) is successful, the vehicle 10 proceeds toward a metal wire stall 23 installed at the toll booth 2. The In-Vehicle Unit (IVU) then transmits an encrypted code for verification before tolls can be deducted from the IC card (IC).

6. If the vehicle 10 is unable to transmit an encrypted code for verification, or if the encrypted code is invalid, a photographic equipment 25 is activated by the control system 15 to take a picture of the vehicle 10 for use as evidence of toll evasion.

7. After the vehicle 10 has passed through the toll booth 2, the In-Vehicle Unit (IVU) returns to the sleep mode to conserve energy.

The following is a more detailed description of the different operating stages of the preferred embodiment:

1. In the first stage, the In-Vehicle Unit (IVU) of the vehicle 10 receives a reset signal as the vehicle 10 passes by the auxiliary roadside communication tower 11 located 3 kilometers from the toll booth 2. The In-Vehicle Unit (IVU) resets the previous toll payment record and the recorded toll station code to 0.

2. In the second stage, toll collecting and payment information are exchanged. The main roadside communication tower 13 transmits continuously downlink communication packets to the vehicle 10 as it proceeds toward the toll booth 2. These communication packets contain a synchronization code, an error checking code, toll payment information, such as the amount of tolls to be paid, the toll station code, and the available uplink communication channels. Upon receiving one of the packets from the tower 13, the In-Vehicle Unit (IVU) selects an available uplink communication channel to conduct communication with the tower 13. The In-Vehicle Unit (IVU) then transmits toll payment information, such as the vehicle ID and type code, the card number and balance of the IC card (IC) of the In-Vehicle Unit (IVU), etc. When the communication tower 13 receives the packets transmitted by the In-Vehicle Unit (IVU), the communication tower 13 passes the same to the toll collecting control system 15 to verify the data. If all data are valid, the communication tower 13 will then broadcast the amount of tolls due via a downlink communication channel corresponding to the selected uplink communication channel. If any problem regarding the data transmitted by the In-Vehicle Unit (IVU) is encountered, such as insufficient card balance, the communication tower 13 will instruct the In-Vehicle Unit (IVU) to instruct the motorist to switch to other lanes where the tolls are collected manually. In case errors are found in the uplink communication packets transmitted by the In-Vehicle Unit (IVU) or when collision occurs due to two In-Vehicle Units (IVU) choosing the same communication channel at the same time, the In-Vehicle Units (IVU) do not receive a downlink communication packet from the tower 13. The In-Vehicle Units (IVU) will then wait a random time and choose another free channel to transmit signals so as to minimize the risk of another collision.

3. The metal wire stall 23 is preferably 5 meters in length and is installed at the toll booth 2 to prevent interference and leakage of signal transmission. As the vehicle 10 passes by the wire stall 23, the In-Vehicle Unit (IVU) will receive signals from an antenna 27 of the wire stall 23 to request the transmission of a code for verification. The In-Vehicle Unit (IVU) responds by sending an encrypted code which is received by the antenna 27. The antenna 27 passes the received code to a lane controller 21 which, in turn, sends the same to the control system 15 for verification. A vehicle type detector 29 can be installed in the wire stall 23 to ensure that the actual type of the vehicle 10 matches the information sent by the In-Vehicle Unit (IVU). This measure is designed to discourage the owner of a large vehicle from using the In-Vehicle Unit (IVU) of a smaller vehicle to avoid payment of higher tolls. If the vehicle 10 passes both the ID verification and vehicle type checks, it will proceed to leave the wire stall 23. In the meantime, the In-Vehicle Unit (IVU) is instructed to deduct the tolls from the balance of the IC card (IC) and a green lamp is activated at the toll booth 2 to indicate that the tolls have been paid. If the vehicle 10 fails to settle the amount of tolls due, a red lamp is activated to indicate that the vehicle 10 is passing through the toll booth 2 illegally. The lane controller 21 activates the monitoring photographic equipment 25 to take a picture of the license plate of the vehicle 10 to serve as evidence of delinquency and/or notifies the highway patrol to intercept the vehicle 10.

After paying the tolls due, the In-Vehicle Unit (IVU) will automatically erase the data stored therein during the communication exchange procedure while retaining the toll station code. The In-vehicle Unit (IVU) then reverts to the sleep mode to conserve energy.

As the vehicle 10 passes through the main roadside communication tower 13, the In-Vehicle Unit (IVU) is awakened from the sleep mode and checks if the IC card (IC) is properly inserted. If the IC card (IC) was not properly inserted, the In-Vehicle Unit (IVU) alerts the motorist by activating a warning lamp (LP) or a buzzer (BZ) thereof. As soon as the IC card (IC) is inserted, the In-Vehicle Unit (IVU) conducts a diagnostic test to determine if the In-Vehicle Unit (IVU) is in good condition, including checking if the IC card (IC) is damaged and if the data stored in the card (IC) is in good order and the balance of the card (IC) is sufficient. If the In-Vehicle unit (IVU) fails in any of the above checks, the motorist will be instructed to switch to other lanes where tolls can be collected manually.

Note that the In-Vehicle Unit (IVU) retains the toll station code after the vehicle 10 passes through the same. When the vehicle 10 proceeds to leave the toll booth 2, it will enter the range of a main communication tower 33 that is positioned on the opposite direction and will receive signals demanding payment from the same. At this stage, the In-Vehicle Unit (IVU) will compare the toll station code that demands payment with that retained in its memory. If both codes are the same, the In-Vehicle Unit (IVU) will recognize that the signals are transmitted from the main communication tower 33 that is positioned on the opposite direction and will disregard these signals. The In-Vehicle Unit (IVU) then returns to the sleep mode.

As the vehicle 10 continues to proceed, the In-Vehicle Unit (IVU) will receive signals from the auxiliary communication tower 31 on the opposite direction to request resetting of the In-Vehicle Unit (IVU). The In-Vehicle Unit (IVU) responds by resetting the toll station code recorded thereby.. This procedure is designed to prevent the vehicle 10 from evading payment if the vehicle 10 leaves the highway after paying the toll and gets on the highway again from the opposite direction.

In the preferred embodiment, five major categories of signals were processed: the reset signals transmitted by the communication tower 11, the downlink communication signals packets transmitted by the main communication tower 13, the toll payment signals transmitted by the In-Vehicle Unit (IVU), the code request signals transmitted by the antenna 27 for vehicle identification, and the signals transmitted by the In-Vehicle Unit (IVU) for ID verification.

The reset signals are used to control resetting of the record stored in the In-Vehicle Unit (IVU) when the vehicle 10 approaches the toll booth 2. As mentioned beforehand, it is quite likely that the In-Vehicle Unit (IVU) may retain the previous toll station code. As soon as the In-Vehicle Unit (IVU) receives the reset signals, the toll station code will be reset to 0. Normally, the In-Vehicle Unit (IVU) is in a sleep mode and is activated to be in a signal receiving mode at certain intervals. When the reset signals are detected, the In-Vehicle Unit (IVU) further resets the previous toll payment record and reverts to the sleep mode.

The downlink communication packets contain data regarding the license tag of the vehicle, the amount of tolls due, the toll station code and the available uplink communication channels. If the balance of the IC card (IC) cannot cover the tolls due, the motorist is instructed to switch to other lanes where tolls can be collected manually. The status of each communication channel can be identified by either "1" or "0": "1" indicates that the channel is available, while "0" indicates that the channel is busy. The In-Vehicle Unit (IVU) selects any channel that is identified by "1" when transmitting to the main roadside communication tower 13 toll payment information, such as the license plate number of the vehicle, the code of the vehicle type, the IC card number and balance. After the vehicle 10 completes communication with the communication tower 13 and enters the wire stall 23, the In-Vehicle Unit (IVU) receives signals such as "OFOF . . . OFOF" from the antenna 27 to request ID verification. Upon receiving these request signals, the In-Vehicle Unit (IVU) transmits a confidential code which includes the license plate number of the vehicle 10 and an encrypted code which is derived from the license plate number with the use of a certain formula that is designed by the local highway authority. Only when the encrypted code matches that which is derived by the toll collecting control system 15 using the same formula shall the verification process be deemed validated.

Figure 3:
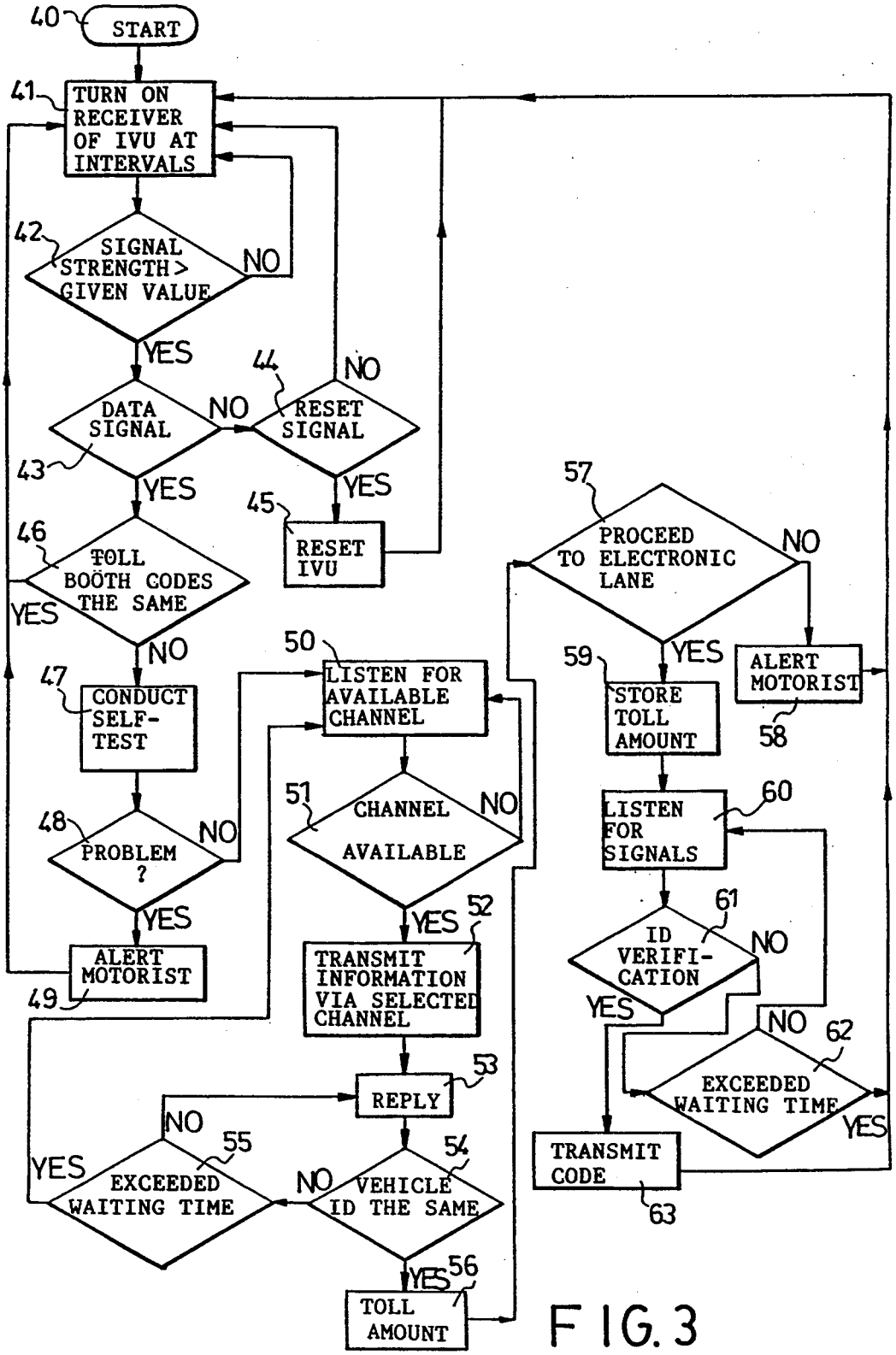
FIG. 3 is a flowchart which illustrates the operation of the In-Vehicle Unit of the preferred embodiment.

The operation of the In-Vehicle Unit (IVU) is described in greater detail with reference to the flowchart shown in FIG. 3. Initially, the In-Vehicle Unit (IVU) is in a sleep mode (block 40). In block 41, the In-Vehicle Unit (IVU) turns on its receiver to detect the presence of input signals at certain intervals. In block 42, the input signals are measured against a given value. If the input signals are weaker than the given value, block 41 is performed repeatedly until the input signals are stronger than the given value. In block 43, the input signals are classified into data or control signals. If the input signals are control signals, the process will flow to block 44 to determine whether the input signals are reset signals. If the input signals are reset signals, the In-Vehicle Unit (IVU) is reset (block 45), and the process reverts to block 41. Otherwise, the process reverts automatically to block 41 where the In-Vehicle Unit (IVU) is maintained in a sleep mode and continues to detect the presence of input signals.

If data signals are present when block 43 is performed, the process flows to block 46 so as to compare the toll station code stored in the In-Vehicle Unit (IVU) with that corresponding to the input signals. If the toll station codes are the same, the process reverts automatically to block 41 where the In-Vehicle Unit (IVU) goes back to the sleep mode. If the toll station codes are different, block 47 is performed to control the In-Vehicle Unit (IVU) to conduct a self-test. The process then continues on to block 48. If any problem was detected during the self-test, block 49 is performed to enable the In-Vehicle Unit. (IVU) to alert the motorist with a warning light signal or a beeping sound signal by means of the warning lamp (LP) and the buzzer (BZ), thus instructing the motorist to switch to other lanes where the tolls can be collected manually. The process then reverts to block 41.

If no problem was detected after the self-test was conducted, block 50 is then performed in which the In-Vehicle Unit (IVU) listens for available uplink communication channels. In block 51, the In-Vehicle Unit (IVU) searches for an available uplink communication channel. If no uplink communication channel is available, the process flows back to block 50. When an uplink communication channel is available, block 52 is performed to enable the In-Vehicle Unit (IVU) to transmit toll payment information via a selected available uplink communication channel. The process then proceeds to block 53 where the In-Vehicle Unit (IVU) will receive a reply from the communication tower 13 via a corresponding downlink communication channel after the uplink communication packets transmitted by the In-Vehicle Unit (IVU) have been processed by the toll collection control system 15. The process then flows to block 54 to enable the In-Vehicle Unit (IVU) to match the code of the downlink communication packet with that of the In-Vehicle Unit (IVU). When a match is detected, the In-Vehicle Unit (IVU) will receive signals regarding the amount of tolls due (block 55). Otherwise, the In-Vehicle Unit (IVU) determines whether the waiting period has exceeded a given value. If the waiting period is under the given value, the process flows back to block 53, wherein the In-Vehicle Unit (IVU) will continue to wait for the proper downlink communication packet. If two In-Vehicle Units (IVU) choose the same communication channel during transmission, collision or mistakes can easily occur. Thus, the waiting period may exceed the given value. If such is the case, the process flows back to block 50. In block 54, if the In-Vehicle Unit (IVU) receives a downlink communication packet that bears its code, the In-Vehicle Unit (IVU) makes sure that the signals received are payment data that have been confirmed by the control system 15 and records the toll station code. In block 57, based on the signals received thereby, the In-Vehicle Unit (IVU) decides whether to proceed on the lanes where tolls can be collected electronically. In case that the card balance is insufficient to cover the amount of tolls due or in other special cases, the In-Vehicle Unit (IVU) will alert the motorist by activating the warning lamp (LP) or the buzzer (BZ), thus instructing the motorist to switch to other lanes where the tolls can be collected manually (block 58). The process then flows back to block 41. If the In-Vehicle Unit (IVU) has given permission that the vehicle 10 can proceed on an electronic lane, the toll amount specified in the reply from the communication tower 13 will be stored temporarily in the memory of the In-Vehicle Unit (IVU) (block 59). The In-Vehicle Unit (IVU) then continues to listen for signals (block 60).

As the vehicle 10 approaches the metal wire stall 23, block 61 is performed to enable the In-Vehicle Unit (IVU) to determine whether the signals received are requests for ID verification. If the signals are not requests for ID verification, the process flows to block 62 where the In-Vehicle Unit (IVU) decides whether the waiting period has exceeded a preset interval. If the waiting period has not yet exceeded the preset interval, the process flows back to block 60 where the In-Vehicle Unit (IVU) continues to listen for requests for ID verification. The process returns to block 41 when the waiting period has exceeded the preset interval. This measure is designed to prevent erroneous charging of a motorist traveling on a non-toll service road that is parallel to the highway. Note that the In-Vehicle Unit (IVU) of a vehicle traveling on the service road may receive all of the signals except for the request for ID verification that can only be received by the vehicle 10 inside the metal wire stall 23. If the In-Vehicle Unit (IVU) receives the signals requesting for ID verification before the preset interval, the process will flow to block 63 where the In-Vehicle Unit (IVU) transmits, in the metal wire stall 23, the license plate number of the vehicle 10 and the corresponding encrypted code.. The metal wire stall 23 is designed to avoid detection of the transmission of the encrypted code by other motorists to ensure the secrecy of the code. In the meantime, if the identification of the vehicle 10 has been validated, the control system 15 provides control signals to the In-Vehicle Unit (IVU) via the antenna 27 so as to instruct the In-Vehicle Unit (IVU) to deduct the toll amount stored in its memory from the card balance. Finally, the process flows back to block 41 to return the In-Vehicle Unit (IVU) to the sleep mode.

The feasibility of the toll collection method and system of the present invention has been tested with simulations based on the queuing theory. In one simulation, the following assumptions are made:

1. The information packets exchange between the In-Vehicle Units (IVU) and the communication tower 13 starts at 1.5 kilometers before the toll booth 2. There are no more than four lanes of traffic on each side of the highway.

2. Vehicles 10 arrive at the toll booth 2 according to the Poisson distribution and, based on a study conducted at different levels of traffic flow, the minimum inter-arrival time in each lane is 1.5 seconds. Thus, there will be a maximum of 2.67 vehicles entering the system at the same time.

3. The uplink and downlink communication channels adopt the same bit rate, e.g. 1200 bits per second, for data transmission.

4. The size of the uplink packet is fixed at 224 bits.

5. In a worst case condition, the bit error rate may be as high as 0.01. Assuming that the base station is capable of detecting errors and correcting one erroneous bit in a 64-bit packet, the probability of successfully transmitting an uplink packet is 0.64.

6. The maximum speed for vehicles 10 entering the range of the system is to be capped at 100 km/hr and the range of communication covered by the communication tower 13 is 500 meters.

7. When more than one In-Vehicle Unit (IVU) selects simultaneously the same communication channel to transmit uplink communication packets to the communication tower 13, collision occurs. The packets may be discarded by the system due to the serious errors arising from interference in a wireless medium. Under such circumstances, the In-Vehicle Units (IVU) will not receive an acknowledgement from the communication tower 13 within an interval of T seconds which is at least twice the time required to send a packet. The In-Vehicle Units (IVU) will then wait a random time which is evenly distributed within a one-second interval before retransmitting the packets.

8. If there is more than one communication channel available, the In-Vehicle Unit (IVU) will select one channel randomly.

The results of the above simulation are as follows: When downlink packet sizes ranging from 96 to 224 bits/packet were transmitted at a bit rate of 1200 bps, the mean time for transmitting a correct uplink packet successfully was found to be from 0.9 to 1.5 seconds, the maximum time required for transmitting an uplink packet was found to be from 9 to 14.6 seconds, the mean number for retransmitting packets was found to be from 0.7 to 1, the mean number of times required for successfully retransmitting packets was found to be from 9 to 14 packets, and the mean number of colliding packets was found to be from 0.15 to 0.4. None of the In-Vehicle Units (IVU) failed the transmission.

The advantages and characterizing features of the two-way packet radio-based electronic toll collection method and system of the present invention are as follows:

1. Since the present invention employs a multiple access method, and since the In-Vehicle Unit is capable of transmitting and receiving signals, the toll collection system can accommodate the requirements of an Intelligent Vehicle Highway System.

2. By adopting wide area communication, the present invention can process a large volume of data simultaneously and thus handle a large volume of traffic.

3. The present invention is easy to implement. An existing toll booth can be easily converted to collect tolls electronically.

4. The communication towers employed in the present invention can be installed at any desired location. Thus, the quality of communication can be controlled by adjusting the location of the communication towers.

5. The toll collecting process of the present invention is spread apart to allow a vehicle to complete the payment process without slowing down. The present invention also permits the collection of tolls from more than one vehicle traveling the same lane during congested conditions.

6. The present invention is cost-effective. Most of the time, the In-Vehicle Unit (IVU) is in a sleep mode to conserve energy.

7. Expansion of the system of the present invention is easy to undertake. There is no need to add communication towers when adding extra lanes.

While the present invention has been described in connection with what is considered the most practical and preferred embodiment, it is understood that this invention is not limited to the disclosed embodiment, but is intended to cover various arrangements included within the spirit and scope of the broadest interpretation so as to encompass all such modifications and equivalent arrangements.

I claim:

1. A two-way packet radio-based electronic toll collection method to be implemented on a highway, comprising the steps of:

providing a communication tower which transmits continuously downlink communication packets that contain information regarding available uplink communication channels;

installing an in-vehicle unit in each vehicle passing along the highway to receive said downlink communication packets, said in-vehicle unit selecting one of said available uplink communication channels; and exchanging toll collecting and payment information wirelessly between said in-vehicle unit and said communication tower via said one of said available uplink communication channels selected by said in-vehicle unit and a downlink communication channel corresponding thereto;

whereby, said method permits multiple users to compete for available said uplink communication channels to exchange said toll collecting and payment information simultaneously.

2. The two-way packet radio-based electronic toll collection method as claimed in claim 1, wherein said exchanging step comprises the steps of:

at said in-vehicle unit, transmitting said toll payment information, including vehicle identification and type data and card number and balance of an IC card of said in-vehicle unit, to said communication tower via said one of said available uplink communication channels selected by said in-vehicle unit; and at said communication tower, transmitting said toll collecting information, including amount of tolls to be paid, to said in-vehicle unit via the corresponding said downlink communication channel.

3. The two-way packet radio-based electronic toll collection method as claimed in claim 2, further comprising the steps of:

verifying the vehicle type after confirming that exchange of said toll collecting and payment information have been conducted; and paying the amount of tolls due electronically when the vehicle type is valid.

4. The two-way packet radio-based electronic toll collection method as claimed in claim 2, further comprising the steps of:

generating a code request signal to said in-vehicle unit of the vehicle passing through a toll booth;

at said in-vehicle unit, transmitting wirelessly a predetermined code upon reception of said code request signal; and inspecting said code to determine whether identification of the vehicle passing through the toll booth is valid.

5. The two-way packet radio-based electronic toll collection method as claimed in claim 4, wherein said paying step comprises the step of instructing said in-vehicle unit to deduct the amount of tolls due from the balance of said IC card when the identification of the vehicle passing through the toll booth is valid.

6. The two-way packet radio-based electronic toll collection method as claimed in claim 5, wherein said predetermined code includes a license plate number of the vehicle and an encrypted code derived from the license plate number.

7. The two-way packet radio-based electronic toll collection method as claimed in claim 5, further comprising the step of photographing a license plate of the vehicle passing through the toll booth when the identification of the vehicle is invalid.

8. The two-way packet radio-based electronic toll collection method as claimed in claim 2, further comprising the step of:

at said in-vehicle unit, instructing a driver of the vehicle to switch to other lanes of the highway where tolls can be collected manually when the IC card cannot be validated or when the balance of said IC card is insufficient to cover the amount of tolls to be paid.

9. The two-way packet radio-based electronic toll collection method as claimed in claim 2, further comprising the steps of:

at said communication tower, disregarding said toll payment information of one said uplink communication channel used by more than one said in-vehicle units at the same time; and at said in-vehicle unit, retransmitting said toll payment information to said communication tower via another one of said available uplink communication channels when said in-vehicle unit fails to receive said toll payment information from said communication tower after a predetermined period of time.

10. The two-way packet radio-based electronic toll collection method as claimed in claim 1, further comprising the step of leaving said in-vehicle unit in an energy saving sleep mode when strength of signals received thereby is less than a given value.

11. A two-way packet radio-based electronic toll collection system to be installed on a highway, comprising:

a main communication tower for transmitting continuously downlink communication packets that contain information regarding available uplink communication channels; and an in-vehicle unit installed in each vehicle passing along the highway to receive said downlink communication packets, said in-vehicle unit selecting one of said available uplink communication channels;

said in-vehicle unit and said main communication tower exchanging toll collecting and payment information wirelessly via said one of said available uplink communication channels selected by said in-vehicle unit and a downlink communication channel corresponding thereto.

12. The two-way packet radio-based electronic toll collection system as claimed in claim 11, wherein:

said in-vehicle unit has an IC card and transmits said toll payment information, including vehicle identification and type data and card number and balance of said IC card, to said main communication tower via said one of said available uplink communication channels selected thereby; and said main communication tower transmits said toll collecting information, including amount of tolls to be paid, to said in-vehicle unit via the corresponding said downlink communication channel.

13. The two-way packet radio-based electronic toll collection system as claimed in claim 12, further comprising:

a toll booth located a predetermined distance after said main communication tower;

means for identifying the vehicle passing through said toll booth.

14. The two-way packet radio-based electronic toll collection system as claimed in claim 13, wherein said identifying means comprises:

a metal wire stall provided on said toll booth and equipped with an antenna; and a lane controller for controlling said antenna to generate a code request signal to said in-vehicle unit of the vehicle passing through said toll booth;

said in-vehicle unit transmitting wirelessly a predetermined code to said antenna upon reception of said code request signal;

said antenna passing said code to said lane controller to enable said lane controller to inspect said code and determine whether identification of the vehicle passing through said toll booth is valid.

15. The two-way packet radio-based electronic toll collection system as claimed in claim 14, wherein said control system provides confirmation signals to said in-vehicle unit via said antenna to instruct said in-vehicle unit to deduct the amount of tolls due from the balance of said IC card when the identification of the vehicle passing through the toll booth is valid.

16. The two-way packet radio-based electronic toll collection system as claimed in claim 15, wherein said predetermined code includes a license plate number of the vehicle and an encrypted code derived from the license plate number.

17. The two-way packet radio-based electronic toll collection system as claimed in claim 15, further comprising photographing equipment controlled by said lane controller for photographing a license plate of the vehicle passing through said toll booth when the identification of the vehicle is invalid.

18. The two-way packet radio-based electronic toll collection system as claimed in claim 12, wherein said in-vehicle unit further comprises means for instructing a driver of the vehicle to switch to other lanes of the highway where tolls can be collected manually when the balance of said IC card is insufficient to cover the amount of tolls to be paid.

19. The two-way packet radio-based electronic toll collection system as claimed in claim 11, wherein said in-vehicle unit is in an energy saving sleep mode when strength of signals received thereby is less than a given value.

20. The two-way packet radio-based electronic toll collection system as claimed in claim 13, further comprising:

means for detecting actual type of the vehicle passing through said toll booth; and photographic equipment controlled by said detecting means for photographing a license plate of the vehicle passing through the toll booth when the actual type detected is different from that of said vehicle identification data.

* * * * *